US006071214A

United States Patent [19]

Osterman

[11] Patent Number: 6,071,214

[45] Date of Patent: Jun. 6, 2000

[54] EXERCISE DEVICE

[75] Inventor: Charles Melville Osterman, Howell, Mich.

[73] Assignee: All Around Sports, Inc., Howell, Mich.

[21] Appl. No.: 08/711,037

[22] Filed: Sep. 10, 1996

[51] Int. Cl.[7] ..... A63B 23/14

[52] U.S. Cl. ..... 482/44; 482/45

[58] Field of Search ..... 482/44–46, 49, 482/114, 115, 126

[56] References Cited

U.S. PATENT DOCUMENTS

| | | | |
|---|---|---|---|
| 3,069,161 | 12/1962 | Melchiona . | |
| 3,132,861 | 5/1964 | Horney . | |
| 3,184,234 | 5/1965 | Struble . | |
| 3,649,008 | 3/1972 | Zinken | 482/46 |
| 3,666,267 | 5/1972 | McKinney . | |
| 3,708,164 | 1/1973 | Griffin . | |
| 4,171,802 | 10/1979 | Stoecker . | |
| 4,344,615 | 8/1982 | Carlson | 482/46 |
| 4,643,417 | 2/1987 | Nieman . | |
| 4,695,049 | 9/1987 | Ciemiega . | |
| 4,838,542 | 6/1989 | Wilkinson . | |
| 5,046,727 | 9/1991 | Wilkinson et al. . | |
| 5,167,596 | 12/1992 | Ferber . | |
| 5,184,986 | 2/1993 | Wilkinson et al. . | |
| 5,244,442 | 9/1993 | Schill . | |
| 5,263,908 | 11/1993 | Chen . | |
| 5,690,598 | 11/1997 | Liang | 482/127 |

*Primary Examiner*—Richard J. Apley
*Assistant Examiner*—Denise Pothier
*Attorney, Agent, or Firm*—Brooks & Kushman P.C.

[57] ABSTRACT

An exercise device comprising a first grip and a second grip, both the first grip and second grip having a longitudinal grip and a transverse grip, the longitudinal grip having a longitudinal diameter and the transverse grip having a transverse diameter greater than the longitudinal diameter, the second grip being torsionally connected to the first grip such that the longitudinal grips are adjacent and such that the torque required to rotate the first grip relative to the second grip can be adjusted via a threaded arrangement.

8 Claims, 2 Drawing Sheets

EXERCISE DEVICE

TECHNICAL FIELD

The present invention relates to an exercise device, and more particularly, to an improved exercise device for exercising the hands, wrists, and arms.

BACKGROUND ART

It is well known that the exercise and development of the hand, wrist, and arm muscles can increase one's ability in a number of sports and recreational activities. Such activities would include, golf, baseball, hockey, bowling, tennis, basketball, horseshoes, javelin, shot put, gymnastics, fly fishing, and many others. When properly exercised and developed, the additional resultant strength in the hand, wrist, and arm muscles can add to power and control.

It is also well known that regimens of physical therapy may include exercises of the hand, wrist, and arm muscles. This is especially the case when one has suffered, and is recovering from, an injury to the hand, wrist, or arm.

Besides sports and recreational activities, and aside from the therapeutic values, many other manual activities may be more easily accomplished by additional hand, wrist, and arm strength.

The hands, wrists, and arms can be exercised by a variety of wrist motions that are easily seen in every day situations. For example, twisting the throttle of a motorcycle, snapping the right hand at the bottom of a golf swing, or dribbling a basketball, are examples of flexion and extension motions. Pronation and supination motions occur when twisting a door knob or throwing a curve ball in baseball. Cocking the left hand at the top of a golf swing, or casting a lure with a fishing rod are examples of abduction and adduction.

While one particular such motion may be emphasized in a particular sport, it is desirable that all such motions be utilized in exercises to strengthen the hands, wrists, and arms. For one reason, it is desirable that the muscles be developed in a balanced manner. Second, because the muscles interrelate, the development of muscles which play a minority role in a particular activity may still lend control and support to those muscles playing a majority role.

Devices are known which have two handles which can be twisted about a common axis for flexion and extension exercising. Examples are shown in U.S. Pat. No. 3,184,234 to Struble; U.S. Pat. No. 4,643,417 to Nieman; U.S. Pat. No. 4,695,049 to Ciemiega; and U.S. Pat. No. 5,244,442 to Schill. However, the single and relatively small diameter handles employed in these devices cannot properly be used for abduction and adduction exercise motions or for pronation and supination exercise motions.

Devices are also known having two handles which can possibly be used for abduction and adduction motion exercises or pronation and supination motion exercises. Examples are shown in U.S. Pat. No. 3,069,161 to Melchiona; U.S. Pat. No. 3,132,861 to Horney; U.S. Pat. No. 3,708,164 to Griffin; U.S. Pat. No. 4,171,802 to Stoecker; and U.S. Pat. No. 5,046,727 to Wilkinson et al. However, all of these examples, with the possible exception of U.S. Pat. No. 3,069,161 to Melchiona, rely on rather complicated mechanisms which are subject to wear and fatigue and are relatively expensive to manufacture. Furthermore, some, like the example shown in U.S. Pat. No. 5,046,727 to Wilkinson et al., cannot properly be used for flexion and extension exercises, while others, such as the examples shown in U.S. Pat. No. 3,069,161 to Melchiona and U.S. Pat. No. 4,171,802 to Stoecker, do not have a cylindrical portion useful for properly performing flexion and extension motion exercises in a comfortable and efficient manner. As to the example disclosed in U.S. Pat. No. 3,069,161 to Melchiona, it does not include means for adjusting the torque between the two handles.

Accordingly, none offer the versatility and relative simplicity of the present invention.

SUMMARY OF THE INVENTION

An object of the present invention is to provide a new and improved exercise device for exercising the hands, wrists, and arms. Another object of the present invention is to provide a new and improved exercise device for exercising the hands, wrists, and arms which is relatively simple and inexpensive to manufacture. Another object of the present invention is to provide a new and improved exercise device for the hands, wrists, and arms which can be used to exercise the hands, wrists, and arms in flexion and extension, pronation and supination, or abduction and adduction motions.

In carrying out the above object, and other objects and features of the present invention, a new and improved exercise device is provided. The exercise device comprises a first grip and a second grip. Both the first grip and second grip have a longitudinal grip and transverse grip. The longitudinal grip has a longitudinal diameter and the transverse grip has a transverse diameter greater than the longitudinal diameter. The second grip is torsionally connected to the first grip such that the longitudinal grips are adjacent and such that the torque required to rotate the first grip relative to the second grip can be adjusted via a threaded arrangement.

Alternatively, the exercise device comprises a first grip having a first longitudinal grip and a first transverse grip, the first longitudinal grip having a first longitudinal diameter and the first transverse grip having a first transverse diameter greater than the first longitudinal diameter. This exercise device also comprises a second grip having a second longitudinal grip and a second transverse grip, the second longitudinal grip having a second longitudinal diameter and the second transverse grip having a second transverse diameter greater than the second longitudinal diameter. A connecting member interconnects the first grip and second grip and frictionally engages at least one of the first grip and second grip such that torque is required to rotate the first grip relative to the second grip. In a preferred embodiment, the connecting member is adjustable such that the frictional force by which the connecting member frictionally engages at least one of the first grip and second grip can be adjusted. In another preferred embodiment, the connecting member has a clamping bore which frictionally engages at least one of the first grip and second grip and the clamping bore may be adjustably reduced such that the frictional force by which the connecting member frictionally engages at least one of the first grip and second grip can be adjusted. In an even more specific embodiment, the clamping bore can be reduced via a threaded arrangement.

In another alternative, the exercise device comprises a first grip having a first clamp end and a second grip having a second clamp end. A connecting member adjustably clamps onto the first clamp end and the second clamp end so as to frictionally engage the first clamp end and second clamp end such that torque is required to rotate the first grip relative to the second grip. In a more specific embodiment, the first grip has a first longitudinal grip adjacent the first clamp end and a first transverse grip adjacent the first longitudinal grip and the second grip has a second longitudinal grip adjacent the second clamp end and a second transverse grip adjacent the second longitudinal grip, the first longitudinal grip having a first longitudinal diameter and the first transverse grip having a first transverse diameter greater than the first longitudinal diameter and the second longitudinal grip having a second longitudinal diameter and the second transverse grip having a second transverse diameter greater than the second longitudinal diameter. In another preferred embodiment, the connecting member has a cylindrical bore into which the first clamp end and second clamp end is inserted and which frictionally engages the first clamp end and second clamp end. In such case, the cylindrical bore can be adjustably reduced such that the frictional force can be adjusted. In a more preferred embodiment, the cylindrical bore is intersected by a longitudinal gap which may be decreased via a clamping mechanism such that the cylindrical bore may be adjustably reduced. In such case, the longitudinal gap may have a top gap edge and a bottom gap edge and the connecting member may have a top projection having a top bore adjacent the top gap edge and a bottom projection having a bottom bore adjacent the bottom gap edge. In such case, the clamping mechanism may be a bolt and nut arrangement which operably runs between and engage the top bore and bottom bore such that the longitudinal gap may be adjusted. Such a bolt and nut arrangement may be a carriage bolt and an adjustment nut.

In all of these alternatives, the longitudinal grips may be substantially cylindrical in shape and the transverse grips may be substantially round, such as spherical or otherwise, in shape.

An advantage of this invention is that it allows the hands, wrists, and arms to be exercised via flexion and extension motions, pronation and supination motions, or abduction and adduction motions. Furthermore, the mechanics of this invention are fairly simple. As a result, the exercise device of this invention is relative inexpensive to make and the separate components are not subjected to excessive wear or fatigue which could lead to component failure. Furthermore, this invention allows the torque required to rotate the grip members, such as the first grip member and second grip member to be easily adjusted.

These objects, features, and advantages, and other objects, features, and advantages of the present invention will be readily apparent to one of ordinary skill in the art from the following description, reference being had to the accompanying drawings where a preferred embodiment of the invention is shown.

BRIEF DESCRIPTION OF THE DRAWINGS

While an embodiment of this invention is illustrated, the particular embodiment shown should not be construed to limit the claims. It is anticipated that various changes and modifications may be made without departing from the scope of the invention covered by the claims.

BEST MODE FOR CARRYING OUT THE INVENTION

Figure 1:
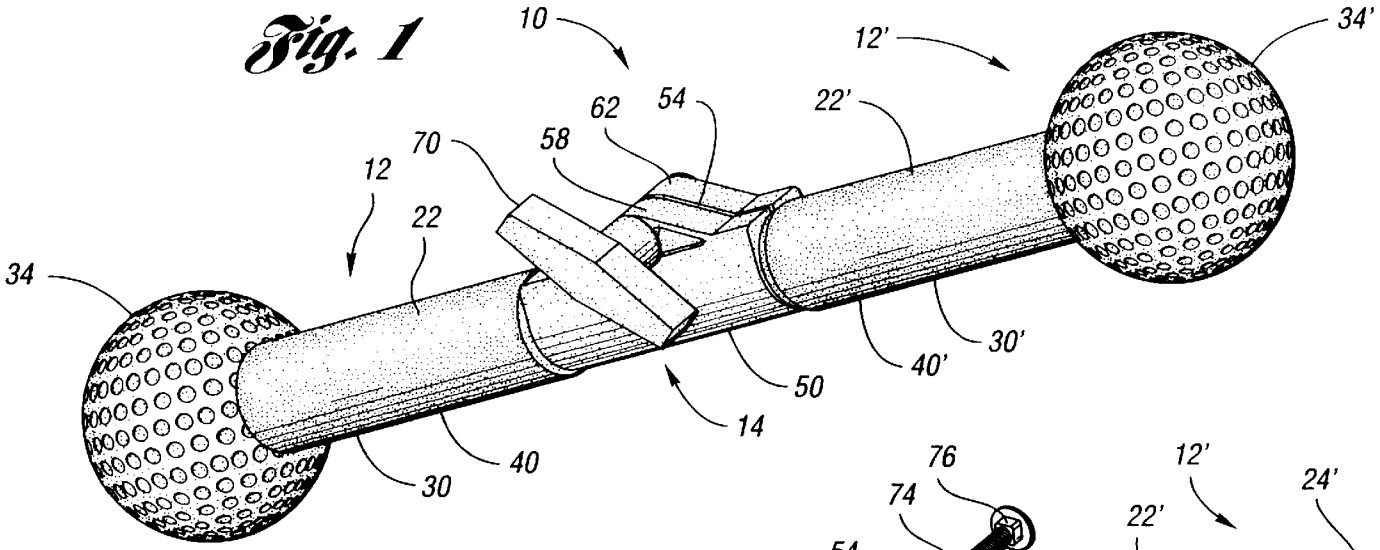
FIG. 1 is an isometric view showing one embodiment of the exercise device of this invention.

FIG. 1 is an isometric view of one embodiment of the exercise device 10 of this invention.

Figure 2:
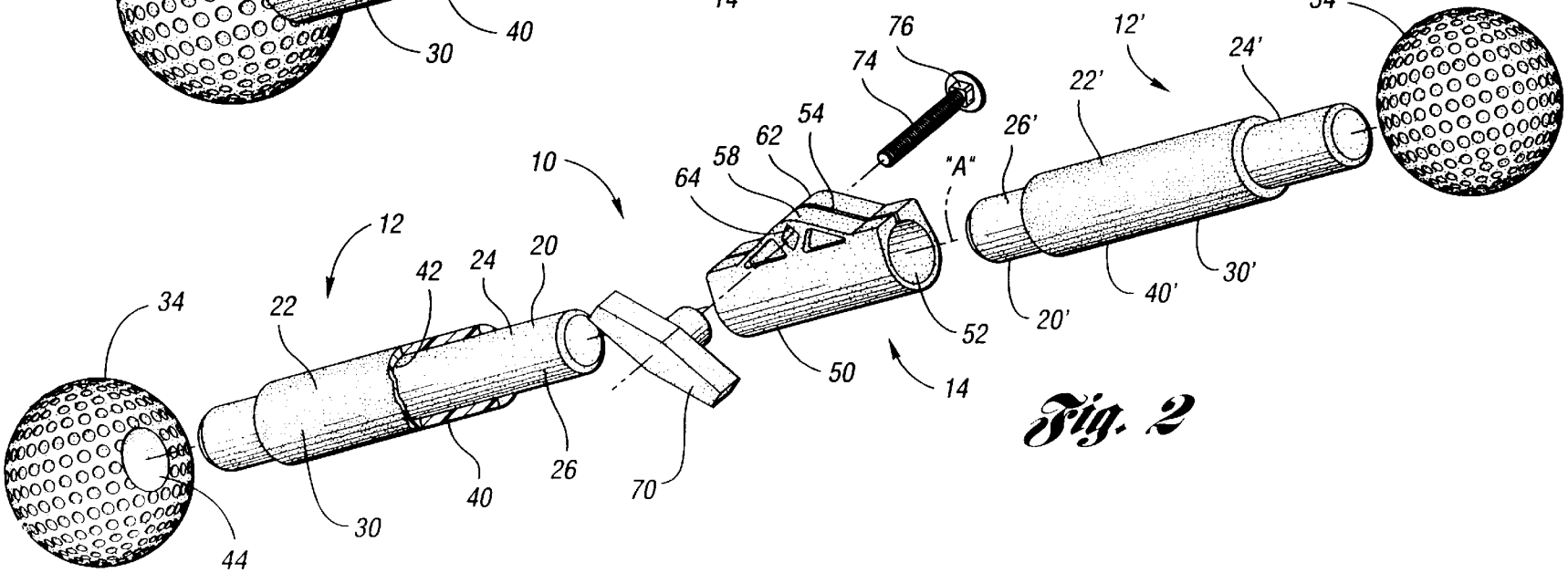
FIG. 2 is an exploded isometric view similar to FIG. 1 showing individual components of the invention in separated positions with the first longitudinal grip partially cut away.
Figure 3:
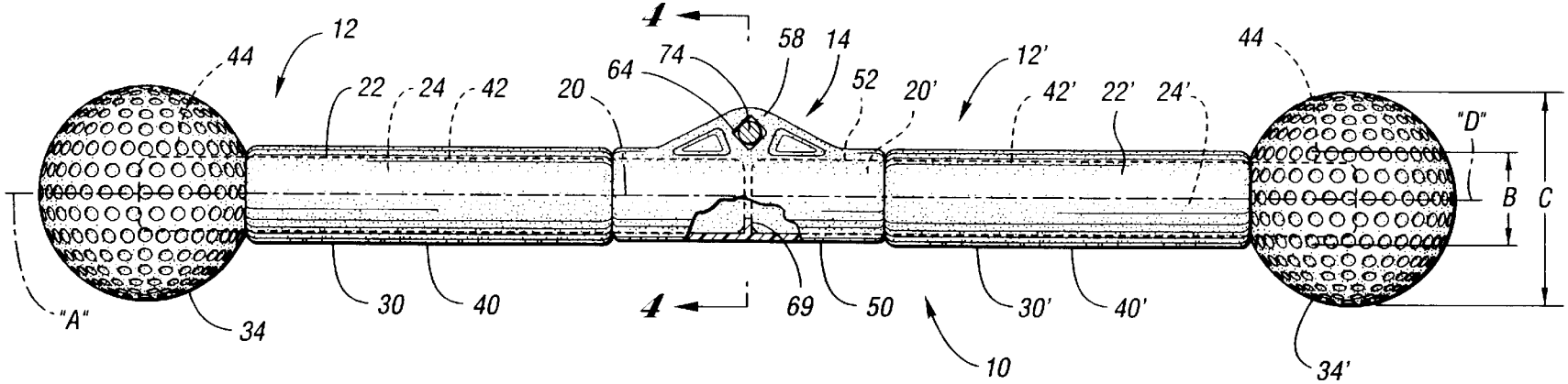
FIG. 3 is a top or bottom view of the embodiment shown in FIG. 1 with the adjustment knob of the clamping mechanism removed and the clamping member partially cut away.

FIG. 2 is an exploded isometric view identical to FIG. 1 except that various components of the exercise device 10 have been separated. FIG. 3 is a plan view of the top or bottom of the exercise device 10 with the adjustment knob removed.

As shown, the exercise device 10 includes a pair of grip members, a first grip member 12 and a second grip member 12', and a connecting member 14.

The first grip member 12 has a first clamp portion 20 and a first grip portion 22. In this embodiment, both the first clamp portion 20 and the first grip portion 22 are aligned along a first longitudinal axis "A". However, it is not necessary that the first clamp portion 20 and first grip portion 22 be so aligned. In an alternative embodiment not shown, the first grip portion 22 could have a first grip axis and the first clamp portion 20 could have a first clamp portion axis, and the first grip axis could be set at an angle to the first clamp portion axis.

In the embodiment shown, the first grip member 12 has been formed from a cylindrical rod 24 having an exposed portion 26. In this embodiment, at least a segment of the exposed portion 26 is the first clamp portion 20.

The cylindrical rod 24 may be made from any suitable material. It has been found that a suitable material from which to make the cylindrical rod 24 is nylon, such as a one-inch diameter rod made from Polypenco® nylon 101. Polypenco® nylon 101 is manufactured by DSM Polymer Corporation, located at 2120 Fairmont Avenue, Reading, Pa. 19605, and can be procured from AIN Plastics of Michigan, Inc. located at 22150 West Eight Mile Road, Southfield, Mich. 48037.

The first grip portion 22 has a first longitudinal grip 30 having a first longitudinal grip diameter "B" and a first transverse grip 34 having a first transverse grip diameter "C". It is preferable that the first transverse grip diameter "C" be greater than the first longitudinal grip diameter "B". In fact, it is preferable that the diameters be such as to facilitate the use of the first longitudinal grip 30 for flexion and extension motion exercises and to facilitate the use of the first transverse grip 34 for the pronation and supination motion or abduction and adduction motion exercises.

While any suitable shape could be used, it is preferable that the first longitudinal grip 30 have a cylindrical type configuration. In the embodiment shown, the first longitudinal grip 30 comprises a cylindrical grip 40 having a throughbore 42. It is preferable that the cylindrical grip 40 be made from a material which may be compressed slightly during use so that it will be comfortable and more easily gripped by the user. A cylindrical grip 40 made from polyvinyl closed cell foam has been found to be suitable. More specifically, a cylindrical grip which may be procured from Eezer Products, Inc. located at 4734 East Home, Fresno, Calif. 93907, and which has been designated stock no. 1001150, has been found to be suitable. As supplied, this cylindrical grip has a throughbore diameter of 0.848" and a thickness of 0.187".

If desired, the outer surface of the longitudinal grip 30 may also be checked, roughened, dimpled, or otherwise varied to aid in gripping the longitudinal grip 30 of the exercise device 10 during use.

While the first transverse grip 34 shown in this embodiment as a spherical-type configuration, any other suitable configuration may be used, including any suitable rounded shape, handle, knob, knurled knob, or oblong shape. In the embodiment shown, the first transverse grip 34 has a bore 44. In the embodiment shown, in the case of the first transverse grip 34 having a spherical-type configuration, it is preferable that the first transverse grip 34 be made from a material which may be compressed slightly during use so that it will be more comfortable and easier to grip by the user. In the spherical-type configuration shown, high density polyurethane foam has been found to be a suitable material. More specifically, a spherical-type transverse grip found to be suitable is the Softuf baseball having a three-inch diameter which can be procured from Master Pitching Machine Company, 4200 N.E. Birmingham Road, Kansas City, Mo. 64117. Of course, if the transverse grip 34 were in the shape of a knurled knob or some such other similar configuration, a more rigid material could be used. Furthermore, like the longitudinal grip 30, the exterior surface of the first transverse grip 34 may be roughened, checked, dimpled, or varied in some other manner in order to aid in gripping the transverse grip 34. In the case of the Softuf baseball, the exterior surface is dimpled so as to aid in gripping the transverse grip 34 during use of the device 10.

It is preferable that the throughbore 42 of the first longitudinal grip 30 and the bore 44 of the first transverse grip 34 be of a diameter such that they can be press fitted onto the cylindrical rod 24. In the case of a cylindrical rod 24 having a one-inch diameter, the stock no. 1001150 cylindrical longitudinal grip from Eezer Products and the Softuf baseball transverse grip, it has been found that a throughbore 42 and a bore 44 having diameters of approximately 0.840" and 0.75" respectively are suitable. In order to ensure that the first longitudinal grip 30 and first transverse grip 34 remain in position relative to the cylindrical rod 24 during use, both are also preferably adhesively bound to the cylindrical rod 24. Suitable adhesives have been found to include Household Goop®, or E6000, which may be procured from Eclectic Products Incorporated located at 995 South A Street, Springfield, Oreg. 97477, or Clear Liquid Nails® For Small Projects And Repairs which may be procured from Macco Adhesives located at 925 Euclid Avenue, Cleveland, Ohio 44115.

While the first longitudinal grip 30 and first transverse grip 34 of this embodiment have been shown as separate components from the cylindrical rod 24, it is also possible that all could be made as a one-piece construction. Alternatively, the transverse grip 34 could remain a separate component while the longitudinal grip 30 could simply constitute the cylindrical rod 24. In such a case, it may be preferable to roughen, check, or otherwise vary that portion of the cylindrical rod 24 constituting the longitudinal grip 30 to aid the user in gripping and using the exercise device 10.

In the embodiment shown, the second grip member 12' is identical to the first grip member 12 and is aligned along a second longitudinal axis "D". In this embodiment the first axis "A" and the second axis "D" are aligned along the first axis "A". Accordingly, all components of the second grip member 12' have been referred to with reference characters identical to those used with regard to the first grip member 12 except that each reference character has been primed. For example, cylindrical rod 24 of the first grip member 12 corresponds to cylindrical rod 24' of the second grip member 12'.

In the embodiment shown, the first grip member 12 and the second grip member 12' have been torsionally connected together in such a manner that the torque required to rotate the first grip member 12 relative to the second grip member 12' about the axis "A" is threadably adjustable via a threaded arrangement. More specifically, in the embodiment shown, the first grip member 12 and the second grip member 12' have been connected together via a connecting member 14. In the embodiment shown, the connecting member 14 includes a clamping member 50.

Figure 4:
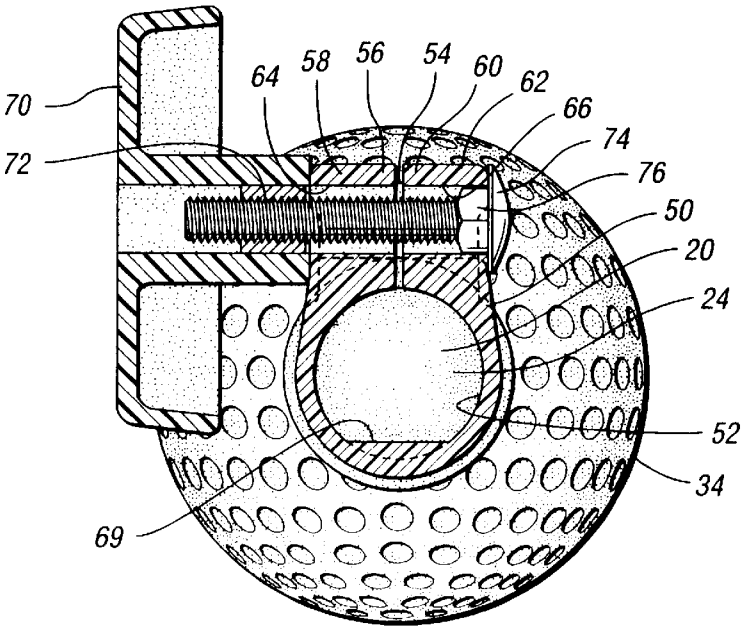
FIG. 4 is a sectional view taken along line 4—4 of FIG. 3 with the adjustment knob in place.

As best seen in FIGS. 3 and 4, the clamping member 50 has a clamping bore 52, cylindrical in this embodiment, intersected by a longitudinal gap 54. Depending on the orientation of the clamping member 50, the longitudinal gap 54 has a top gap edge 56 adjacent to which projects a top projection 58 and a bottom gap edge 60 from adjacent to projects a bottom projection 62. In the embodiment shown, the top projection 58 has a top projection bore 64 and the bottom projection 62 has a bottom projection bore 66. The top projection bore 64 and bottom projection bore 66 are aligned and, for reasons to be explained, have a cylindrical configuration excepting that portion furthest away from the longitudinal gap 54 which has a non-circular configuration. In the embodiment shown, that non-circular configuration is square.

A stop 69 is located within the clamping bore 52. In the embodiment shown, the stop 69 is a small projection within the clamping bore 52 situated approximately halfway in between each end of the clamping bore 52.

The clamping member 50 may be made from any suitable material. A material found to be suitable is acetal which can be procured, under the name Delrin®, from DuPont Company, Barley Mill Plaza, Building 22, P.O. Box 80022, Bloomington, Del. 19880. Another suitable material is Ultraform® which can be procured from BASF Corporation, 3000 Continental Drive North, Mount Olive, N.J. 07828.

The connecting member 14 also includes a clamping mechanism for reducing the clamping bore 52. In the embodiment shown, the clamping bore is reduced by drawing the longitudinal gap 54 together. In the event the cylindrical rod 24 is made from one-inch diameter material, an approximately one-inch prior-to-reduction diameter clamping bore 52 has been found suitable. The clamping mechanism used in this embodiment is a threaded nut member, in this embodiment a clamping adjustment knob 70, and a bolt member, in this embodiment a carriage bolt 74. The adjustment knob 70 has a threaded bore 72. The adjustment knob 70 may be made of any suitable plastic material while it is preferred that the threaded bore 72 be metallic so as to give greater wearability. A suitable adjustment knob 70 made from polypropylene and having a metallic insert threaded bore may be obtained through Reid Tool Supply Company, 2265 Black Creek Road, Muskegon, Mich. 49444 and has a model no. KLK30.

In the embodiment shown, the carriage bolt 74 must have a non-circular shoulder 76. In the embodiment shown, the non-circular shoulder 76 has a square configuration so as to fit within the square portion of the top or bottom projection bores, 64 and 66. Such carriage bolts are commonly known in the art and will not be discussed in further detail here.

The exercise device 10 is assembled by inserting the carriage bolt 74 through the bottom projection bore 66 and top projection bore 64, or vice versa, such that the non-circular shoulder 76 of the carriage bolt 74 engages the non-circular shaped portion of the bottom projection bore 66 or top projection bore 64. The threaded bore 72 of the adjustment knob 70 is then threaded loosely onto the carriage bolt 74. With the first clamp portion 20 and the second clamp portion 20' inserted from each side respectively into the cylinder clamping bore 52 such that the first clamp portion 20 and second clamp portion 20' abut the stop 69, the adjustment knob 70 may then be further tightened so as to decrease the longitudinal gap 54, thereby reducing the clamping bore 52 so as to frictionally clamp or engage the first clamp portion 20 and the second clamp portion 20' of the first grip member 12 and second grip member 12' respectively. Of course, the clamping bore 52 may be allowed to expand, so as to reduce frictional engagement, by loosening the adjustment knob 70. As so assembled, the first and second grip members 12 and 12' are aligned along the axis "A".

When using the exercise device 10, whether for strength and control development or therapeutic purposes, many variations are possible. For example, the first longitudinal and second longitudinal grips 30 and 30' may be gripped by a user with the right and left hands respectively such that both palms face the same direction. The first longitudinal grip 30 and the second longitudinal grip 30' may then be turned in opposite direction in order to exercise the hands, wrists, and arms.

An alternative is to grab the first and the second longitudinal grips 30 and 30' with the right and left hands respectively such that the palms are in opposite directions. This is more easily done with the elbows bent and the wrists near the body. Similar to the relative positions of the hands on a golf club, baseball bat or hockey stick, the handles may then be turned in opposite directions in order to exercise the hands, wrists, and arms.

Each of these foregoing exercises offers the user the ability to exercise the hands, wrists, and arms via flexion and extension motions.

Alternatively, the outside ends of the first and second transverse grips 34 and 34' may be gripped by the right and left hands respectively such that the palms face each other. The first transverse grip 34 and second transverse grip 34' may then be rotated in opposite directions to exercise the hands, wrists, and arms. In this position, and with the backs of the hands roughly parallel to the forearms, the hands, wrists, and arms are exercised via abduction and adduction motions. However, an alternative is to hold one hand near the body such that the back of the hand is bent forward or rearward relative to the forearm. Stated in another manner, the palm of the hand bent forward or back so as to be angled or substantially perpendicular to the forearm. The exercise will then exercises the hands, wrists, and arms via pronation and supination motions when the bent hand is used to rotate the one transverse grip 34 relative to the other transverse grip 34'.

As the user becomes stronger, the torque required to rotate one grip relative to the other may be increased by further tightening the adjustment knob 70. Vice versa, the torque required may be decreased by loosening the adjustment knob 70.

While a particular embodiment of the invention has been illustrated and described, it will be obvious to those skilled in the art that various changes and modifications may be made without departing from the scope of this invention. It is intended that the following claims cover all such modifications and all equivalents that fall within the spirit and scope of this invention.

What is claimed is:

1. An exercise device comprising:

a first grip having a first longitudinal grip and a first transverse grip, the first longitudinal grip having a first longitudinal diameter and the first transverse grip having a first transverse diameter greater than the first longitudinal diameter, a second grip having a second longitudinal grip and a second transverse grip, the second longitudinal grip having a second longitudinal diameter and the second transverse grip having a second transverse diameter greater than the second longitudinal diameter, and a connecting member which interconnects the first grip and second grip, the connecting member having a clamping bore which frictionally engages at least one of the first grip and second grip such that torque is required to rotate the first grip relative to the second grip, the clamping bore being adjustable such that the frictional force by which the connecting member frictionally engages at least one of the first grip and second grip can be adjusted.

2. The exercise device of claim 1 wherein the clamping bore can be reduced by adjusting a threaded arrangement.

3. The exercise device of claim 2 wherein at least one of the first grip and second grip has a clamp end and the connecting member frictionally engages the clamp end.

4. An exercise device comprising:

a first grip having a first clamp end, a second grip having a second clamp end, a connecting member having a cylindrical bore into which the first clamp end and second clamp end is inserted and which frictionally engages the first clamp end and second clamp end such that torque is required to rotate the first grip relative to the second grip, the cylindrical bore being adjustable such that the frictional force by which the cylindrical bore frictionally engages the first clamp end and second clamp can be adjusted.

5. The exercise device of claim 4 wherein the cylindrical bore is intersected by a longitudinal gap which may be decreased by adjusting a clamping mechanism such that the cylindrical bore may be adjustably reduced.

6. The exercise device of claim 5 wherein the longitudinal gap has a top gap edge and a bottom gap edge and the connecting member has a top projection having a top bore adjacent the top gap edge and a bottom projection having a bottom bore adjacent the gap edge and the clamping mechanism is a bolt and nut arrangement which operably runs between and engages the top bore and bottom bore such that the longitudinal gap may be adjusted.

7. An exercise device comprising:

a first grip having a cylindrical first clamp end, a substantially cylindrical first longitudinal grip adjacent the first clamp end, and a first transverse grip adjacent the first longitudinal grip, the first longitudinal grip having a first longitudinal diameter, and the first transverse grip having a first transverse diameter greater than the first longitudinal diameter, the first clamp end, first longitudinal grip, and first transverse grip being aligned along a first axis, and a second grip having a cylindrical second clamp end, a substantially cylindrical second longitudinal grip adjacent the second clamp end, and a second transverse grip adjacent the second longitudinal grip, the second longitudinal grip having a second longitudinal diameter, the second transverse grip having a second transverse diameter greater than the second longitudinal diameter, the second clamp end, second longitudinal grip, and second transverse grip being aligned along a second axis, and a connecting member including a clamp, a threaded bolt member, and a nut member, the clamp having a clamping bore intersected by a longitudinal gap, the longitudinal gap having a top gap edge and a bottom gap edge, the top gap edge having a top projection and the bottom gap edge having a bottom projection, the top projection defining a top bore and the bottom projection defining a bottom bore, the bolt member being situated through the top projection bore and bottom projection bore such that the nut member can be threaded onto the bolt member and tightened after the first clamp end and second clamp end have been inserted within the clamping bore so as to frictionally and adjustably engage the first clamp end and second clamp end such that torque is required to rotate the first grip relative to the second grip and such that the first axis is substantially aligned with the second axis.

8. The exercise device of claim 7 wherein at least one of the top bore and bottom bore has a non-circular portion, the bolt member is a carriage bolt having a non-circular shoulder which non-rotatably engages the non-circular portion, and the nut member is an adjustment knob having a threaded bore.

* * * * *